US005310976A

United States Patent [19]

Beckett

[11] Patent Number: 5,310,976

[45] Date of Patent: May 10, 1994

[54] MICROWAVE HEATING INTENSIFIER

[75] Inventor: Donald G. Beckett, Oakville, Canada

[73] Assignee: Beckett Industries Inc., Oakville, Canada

[21] Appl. No.: 835,457

[22] PCT Filed: Oct. 18, 1990

[86] PCT No.: PCT/CA90/00355

§ 371 Date: Mar. 2, 1992

§ 102(e) Date: Mar. 2, 1992

[87] PCT Pub. No.: WO91/06195

PCT Pub. Date: May 2, 1991

[30] Foreign Application Priority Data

Aug. 23, 1989 [GB] United Kingdom ..... 8923793.7

[51] Int. Cl.[5] ..... H05B 6/80

[52] U.S. Cl. ..... 219/728; 219/759; 99/DIG. 14; 426/234; 426/243

[58] Field of Search ..... 219/10.55 E, 10.55 F; 426/107, 109, 241, 234, 243; 99/DIG. 14

[56] References Cited

U.S. PATENT DOCUMENTS

| | | | |
|---|---|---|---|
| 4,676,857 | 6/1987 | Scharr et al. | 219/10.55 E |
| 4,713,512 | 12/1987 | Wild et al. | 219/10.55 E |
| 4,883,936 | 11/1989 | Maynard et al. | 219/10.55 F |
| 4,962,293 | 10/1990 | Lackey | 219/10.55 E |

FOREIGN PATENT DOCUMENTS

| | | |
|---|---|---|
| 797 | 2/1979 | European Pat. Off. . |
| 1311 | 4/1979 | European Pat. Off. . |
| 2635089 | 2/1990 | France . |
| WO/8904585 | 5/1989 | PCT Int'l Appl. . |

*Primary Examiner*—Philip H. Leung
*Attorney, Agent, or Firm*—Sim & McBurney

[57] ABSTRACT

A microwave energy intensifier is described comprising an array of dots of electroconductive material of microwave-reflecting thickness, particularly aluminum of foil thickness, supported on a dielectric substrate, particularly a flexible polymeric film substrate.

8 Claims, 1 Drawing Sheet

MICROWAVE HEATING INTENSIFIER

FIELD OF INVENTION

The present invention relates to a novel material useful in the microwave heating of foodstuffs.

BACKGROUND TO THE INVENTION

The use of microwave energy to reheat or cook food products for consumption is increasing. Many such food products have a crust. By virtue of its manner of heating, microwave energy does not brown or crispen the crust.

It is well known, for example, from U.S. Pat. No. 4,641,005, that a continuous thin metallic film, generally vapour-deposited aluminum, may be employed to convert a portion of microwave energy incident thereon into thermal energy and that such thermal energy may be employed to effect heating of foodstuffs, particularly for the crispening and browning of outer crust material.

It is also well known that thicker metal films of foil thickness, such as aluminum foil, effectively act to reflect substantially all microwave energy incident thereon, and so act as a shield to prevent microwave energy from passing to the food. Metal film is of foil thickness generally have a thickness of about 0.0001 to about 0.01 inch, typically approximately 0.00035 inch for commercially-available aluminum foil.

There is described in U.S. Pat. No. 4,230,924 a structure which achieves browning of a microwave-cooked foodstuff and comprises a flexible dielectric wrapping sheet having a flexible metallic coating thereon, which may be in the form of aluminum foil. The coating is subdivided into a number of individual metallic islands by criss-crossing non-metallic gaps provided by exposed dielectric strips on the wrapping sheet. The flexible dielectric wrapping sheet is in the form of paperboard. (There is another embodiment disclosed in this reference in which the metallic coating is in the form of a thin film on a polymeric film substrate). In this arrangement, the individual metal foil islands are sized approximately ⅜ inch on a side and the criss-crossing, non-metallic gaps vary from about 0.001 to about 0.0625 inch in width. As described in the patent, the laminate is partially transparent to microwave energy, since microwave energy is permitted to pass through the gaps into a food product wrapped in the laminate to effect dielectric heating. The adjacent metallic islands are said to act as the plates of a capacitor to generate differences in electrical potential therebetween, which results in electrical current flow between the islands through the dielectric substrate. The islands are said to modify the microwave field configuration to achieve an enhance heating of the outer surface of the foodstuff, to effect browning and crispening.

SUMMARY OF INVENTION

It has now surprisingly been found that a novel structure may be provided which comprises a substantially uniform arrangement of small dots of aluminum or other metal of foil thickness (i.e., about 0.0001 to about 0.01 inch) spaced apart a short distance from one another on a suitable dielectric substrate.

The novel structure is useful in the microwave cooking or reheating of foodstuffs for consumption, in that the structure achieves an intensification of the microwave energy field, guiding an enhanced proportion of the microwave energy in the cavity of the microwave oven into the foodstuff, despite including metal of microwave energy-reflecting thickness.

GENERAL DESCRIPTION OF INVENTION AND PREFERRED EMBODIMENT

Figure 1:
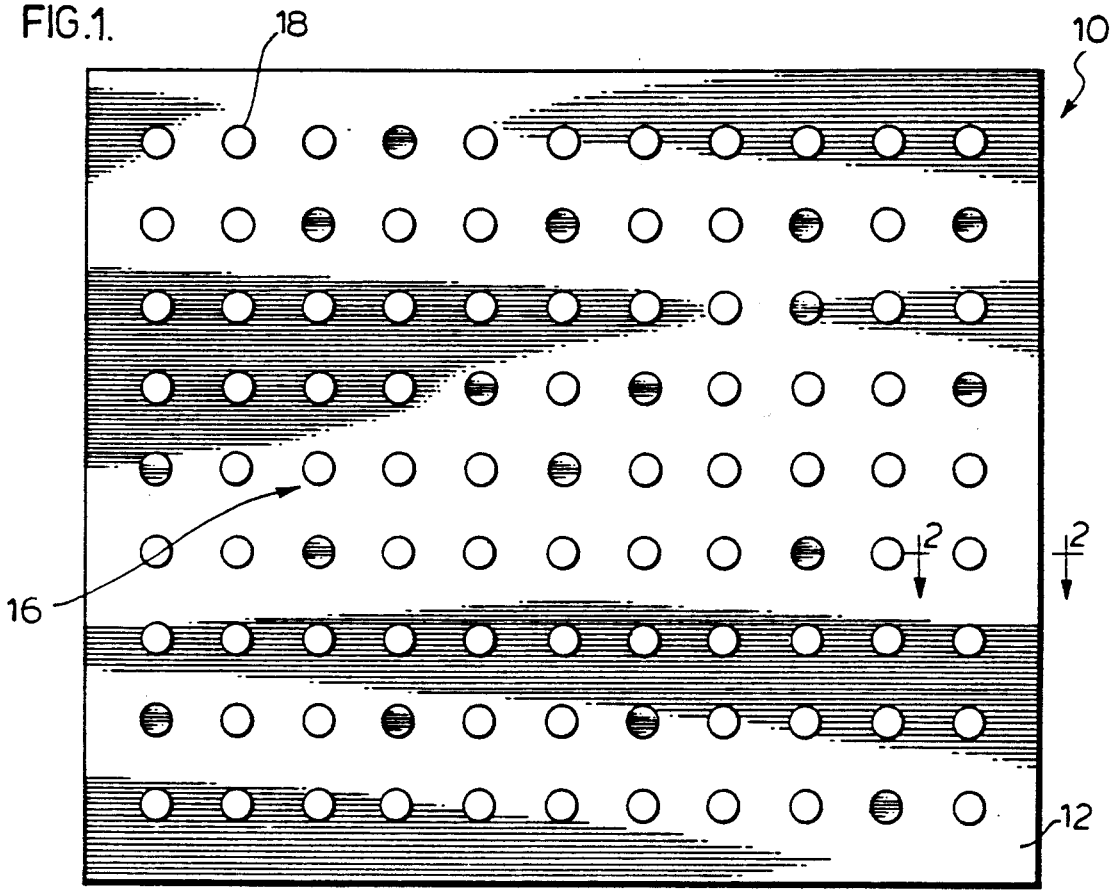
FIG. 1 is a plan view of a microwave intensifier provided in accordance with one embodiment of the invention.
Figure 2:
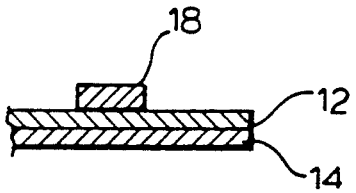
FIG. 2 is a sectional view of the microwave intensifier of FIG. 1 taken along line 2—2 of FIG. 1.

Accordingly, in one aspect, the present invention provides an article of manufacture suitable for use in the microwave cooking of foodstuffs, which comprises a dielectric substrate and an arrangement of small dots of electroconductive material of microwave-reflecting thickness supported on the dielectric substrate and spaced apart a short distance one from another sufficient to effect guidance of an enhanced proportion of incident microwave energy through the substrate.

Generally, the array of dots of aluminum is supported on a flexible polymeric film substrate, such as polyester or polyethylene, which may be laminated to other substrates, such as paper or paperboard, depending on the use to which the structure is to be put.

The array of dots generally is provided as a uniform array of dots, each having a transverse dimension from about 0.0001 to about 0.1 inch, spaced apart a distance of about 0.0001 to about 0.1 inch. The dots generally are all of regular geometrical shape, such as round or square, depending on the manner of formation of the array.

The novel structure of the present invention may be produced by selective demetallization of aluminized polymeric film wherein the aluminum is of foil thickness, using an aqueous etchant, such as aqueous sodium hydroxide solution.

In order to effect such selective demetallization, an etchant resistant material first is applied to the metal surface by screening, so as to provide a series of dots of such etchant-resistant material on the metal in the locations where the metal is not to be removed, corresponding in dimension to the openings in the screen.

Upon subsequent exposure of the surface to the aqueous etchant, aluminum is dissolved from the regions of the surface not protected by the etchant-resistant material, so as to leave the substantially uniform array of aluminum dots on the polymeric film, with aluminum-free regions between the dots.

Procedures for effecting such demetallization are described in U.S. Pat. Nos. 4,398,994 and 4,552,614, assigned to the assignee hereof, and the disclosures of which are incorporated herein by reference.

The size of the dots and the spacings one from another in this embodiment depends on the size of the openings in the screen used to apply the etchant-resistant material, which, in turn, varies the overall density of aluminum metal on the polymeric substrate.

DESCRIPTION OF PREFERRED EMBODIMENT

Referring to the drawings, a microwave intensifier 10 according to one embodiment of the invention, comprises a polymeric film layer 12 laminated, on one side, to a paper layer 14 and, on the other side, having a uniform array 16 of individual round dots 18 of aluminum.

SUMMARY OF DISCLOSURE

In summary of this disclosure, the present invention provides a novel structure which achieves intensification of microwave energy onto a foodstuff being heated by microwave energy, by employing a uniform array of metal dots of foil metal thickness on a suitable substrate. Modifications are possible within the scope of this invention.

What we claim is:

1. An article of manufacture suitable for use in the microwave cooking of foodstuffs, which comprises a dielectric substrate and an array of discrete dots of electroconductive material of microwave-reflecting thickness supported on said dielectric substrate and having a transverse dimension of about 0.0001 to about 0.1 inch and spaced apart one from another by a distance of about 0.0001 to about 0.1 inch sufficient to effect guidance of an enhanced proportion of incident microwave energy through said substrate.

2. The article of manufacture of claim 1 wherein said dielectric substrate is a flexible polymeric film substrate.

3. The article of manufacture of claim 2 wherein said polymeric film substrate is laminated to paper or paperboard.

4. The article of manufacture of claim 2 wherein said electroconductive material is an electro-conductive metal.

5. The article of manufacture of claim 4 wherein said electroconductive metal is aluminum having a thickness of about 0.0001 to about 0.01 inch.

6. The article of manufacture of claim 5 wherein said aluminum has a thickness of approximately 0.00035 inch.

7. The article of manufacture of claim 1, 2, 3, 4, 5 or 6 wherein said arrangement of small dots of electroconductive material is provided in the form of a substantially uniform array on said substrate.

8. The article of manufacture of claim 1, 2, 3, 4, 5 or 6 formed by selective demetallization of metallized polymeric film.

* * * * *